United States Patent [19]

Huston et al.

[11] 4,073,624

[45] Feb. 14, 1978

[54] METHOD FOR FLUORINATING COAL

[75] Inventors: John L. Huston, Skokie; Robert G. Scott, Westmont; Martin H. Studier, Downers Grove, all of Ill.

[73] Assignee: The United States of America as represented by the Department of Energy, Washington, D.C.

[21] Appl. No.: 752,946

[22] Filed: Dec. 21, 1976

[51] Int. Cl.[2] ..... C10L 9/02; C07B 9/00

[52] U.S. Cl. ..... 44/1 R; 260/694

[58] Field of Search ..... 44/1 R; 201/17; 260/694

[56] References Cited

U.S. PATENT DOCUMENTS

| | | | |
|---|---|---|---|
| 1,899,808 | 2/1933 | Kern | 201/17 X |
| 2,057,486 | 10/1936 | Higgins | 201/17 X |
| 2,702,306 | 2/1955 | Gall et al. | 260/694 X |
| 2,808,369 | 10/1957 | Hickey | 201/17 X |

*Primary Examiner*—Carl F. Dees

*Attorney, Agent, or Firm*—Dean E. Carlson; Frank H. Jackson; James W. Weinberger

[57] ABSTRACT

Coal is fluorinated by contact with fluorine gas at low pressure. After partial fluorination, when the reaction rate has slowed, the pressure is slowly increased until fluorination is complete, forming a solid fluorinated coal of approximate composition $CF_{1.55}H_{0.15}$. The fluorinated coal and a solid distillate resulting from vacuum pyrolysis of the fluorinated coal are useful as an internal standard for mass spectrometric unit mass assignments from about 100 to over 1500.

6 Claims, 2 Drawing Figures

METHOD FOR FLUORINATING COAL

CONTRACTUAL ORIGIN OF THE INVENTION

The invention described herein was made in the course of, or under, a contract with the United States Energy Research and Development Administration.

BACKGROUND OF THE INVENTION

This invention relates to a method for fluorinating coal. This invention also relates to a material useful as a mass spectrometric mass reference.

Coal is gaining ever increased attention as a source of power and chemicals, particularly in view of the diminishing supplies of petroleum and natural gas. Large sums of money are being spent to develop new, more efficient and more effective ways to convert coal into other physical forms such as oils and gases for more convenient utilization. In order to develop new methods and processes for changing the physical form of coal, it is necessary to learn more about the chemical structure and composition of the coal itself.

SUMMARY OF THE INVENTION

In order to study and measure the aromaticity of coal, a method has been developed by which coal can be fluorinated to prepare a solid fluorinated coal. By the method of the invention, coal is contacted with elemental fluorine at an initial pressure below about 300 mm Hg, evolving HF for a period of time until the coal is partially fluorinated as evidenced by a lowering of the gas pressure or a reduction in the evolution of HF. At this time the pressure of the fluorine is slowly increased to 1100 to 1600 mm Hg and maintained for a period of time sufficient to complete fluorination of the coal, thereby forming a solid fluorinated coal product.

It has also been discovered that the solid fluorinated coal product resulting from the process of this invention, which may be either the solid fluorinated coal or a solid distillate resulting from the vacuum pyrolysis of the solid fluorinated coal, are very useful for accurate mass spectrometric unit mass assignments. The most common mass spectrometric unit standard presently in use is perfluorokerosene. However, perfluorokerosene as a mass spectrometric standard presents peaks only every 12 or 14 mass units which makes interpolation necessary if unit mass assignments are to be made. The perfluorokerosene peaks may also mask sample peaks and in any event are useful only to an $m/e$ of perhaps 800 at most. The fluorinated coal product of the instant invention, either as the fluorinated coal or as the distillate, presents a peak at every mass unit above about $m/e = 100$. These peaks, particularly above mass 300, are of a uniform character with gradually diminishing intensity, persisting to at least 1500. This permits not only the easy perception (observation) of sample peaks, but also accurate determination of their unit masses.

It is therefore one object of the invention to provide a method for fluorinating coal.

It is the other object of the invention to provide a product which is useful as a mass spectrometric internal standard to provide increased certainty in mass spectrometric unit mass assignments.

DETAILED DESCRIPTION OF THE PREFERRED EMBODIMENT

Figure 1:
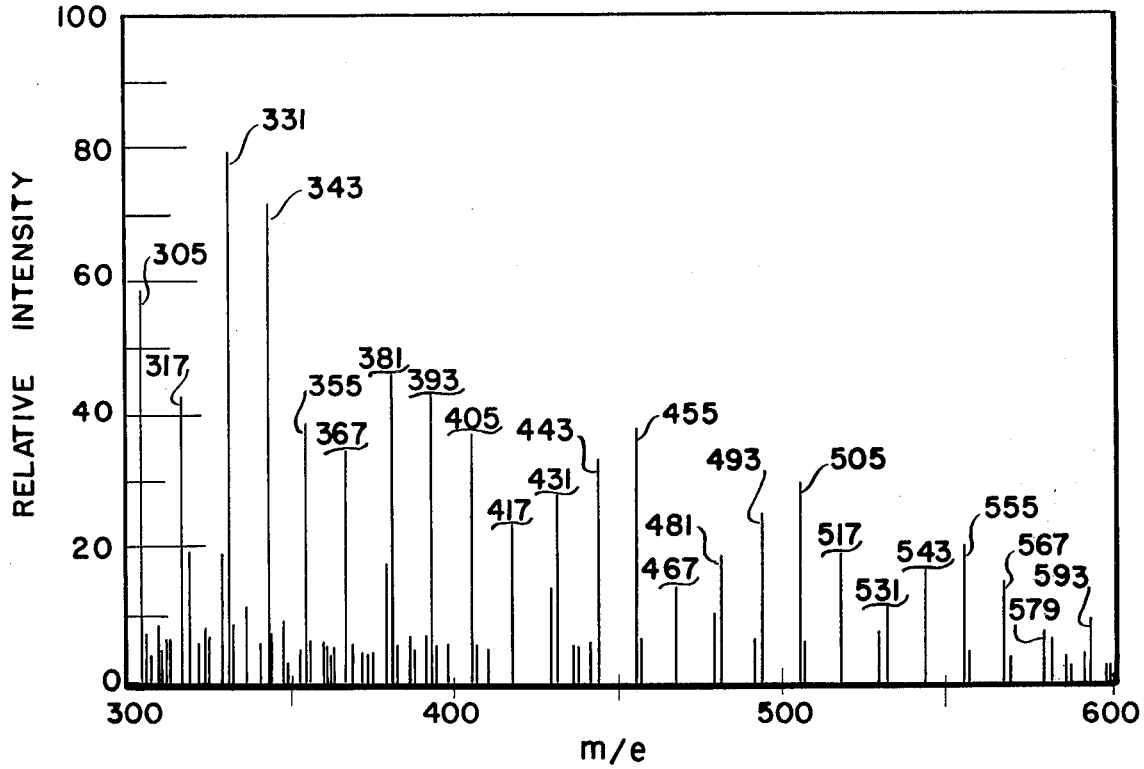
Fig—1 (PRIOR ART)
FIG. 1 depicts the mass spectrum of the commonly used mass standard perfluorokerosene from $m/e$ 300 to 600.

These and other objects of the invention may be met by contacting the coal with elemental fluorine gas at an initial pressure of up to 300 mm Hg, whereby the fluorine reacts with the coal, evolving HF; maintaining the initial pressure of the fluorine until evolution of HF decreases, thereby indicating the coal is partially fluorinated, increasing the pressure of the fluorine gas over the partially fluorinated coal slowly to about 1100 to 1600 mm Hg and maintaining the pressure for a period of time sufficient to completely fluorinate the coal.

It is important that the initial pressure of elemental fluorine over the coal not exceed about 300 mm Hg. Pressures higher than this almost invariably result in spontaneous combustion of the coal. Pressures much lower than 300 mm Hg will merely result in increased fluorination times. The initial pressure of fluorine may range from 50 to about 300 mm Hg.

The initial fluorination pressure over the coal should be maintained until at least partial fluorination of the coal has been effected to prevent a change of later combustion of the coal. The determination of the course of partial fluorination can be made in one of two ways. For experimental purposes, small pellets of NaF were placed with the coal to be fluorinated in order to absorb the HF evolved during the fluorination reaction. Thus as fluorination proceeds the pressure will drop and the weight of NaF increases. Alternatively, the evolved off-gas may be monitored so that a decrease in the evolution of HF will indicate the progress of fluorination at the initial pressure.

Fluorination temperature is preferably ambient although the temperature may vary from about 0° to about 80° C without adversely affecting the process.

Either bituminous or anthracite coal may be used with the process of the invention with equally good results. Due to its porosity, the size of the coal particles appears to have little effect upon the fluorination process other than to increase fluorination times when larger particles are used, although for experimental convenience uniform particles of 35 to 80 U.S. mesh size were used.

After fluorination is complete at the initial pressure, the pressure of the fluorine gas is slowly increased to from about 1100 to about 1600 mm Hg to complete the fluorination reaction. The rate of pressure increase should be rapid enough to maintain continuous fluorination but not promote combustion and will depend upon the type of coal undergoing fluorination since soft coals will generally fluorinate at a faster rate than the anthracite coals. In general, an increase in pressure over a period of from 24 to 48 hours proved sufficient to completely fluorinate the coal as evidenced by a constant weight or lack of HF in the off-gas.

Fluorinated ground bituminous coal is similar in appearance to the coal from which it is made, but the particles contain banded regions of lighter color and some particles become white and translucent. It is presumed that these changes are due to saturation by fluorine of aromatic units in the coal. The fluorinated coal, like the original coal, is a high polymer which is insoluble in dimethyl sulfoxide, dimethyl formamide, etc. and in fluorocarbon solvents and has an approximate composition of $CF_{1.55}H_{0.15}$. Like the original coal, it is friable and easily ground.

If the fluorinated coal product is pyrolyzed in vacuo by heating to 500° C, the polymer breaks up and complete (>99%) distillation takes place with formation of a solid condensate on cool walls of the apparatus. The condensate is soluble in fluorocarbon solvents, e.g. perfluorobenzene. It shows some melting at 110° and largely melts between 128° C and 140° C.

Either the fluorinated coal or the distillation product are useful for mass spectrometric unit mass assignments. Both products vaporize over a temperature range of several hundred degrees which probably includes most temperatures which might be used for the introduction of an organic sample to a mass spectrometer. Another advantage of the use of the products of the invention is that source pressure remains below $2 \times 10^{-6}$ torr which is comparable with perfluorokerosene metered through a valve at room temperature. Accordingly, the compounds can be introduced with an organic sample from a probe and do not require an auxiliary vacuum system. While the mass spectrographic peaks are sparse below mass 100, they are relatively numerous and similar to the peaks obtainable with perfluorokerosene up to mass 300.

Figure 2:
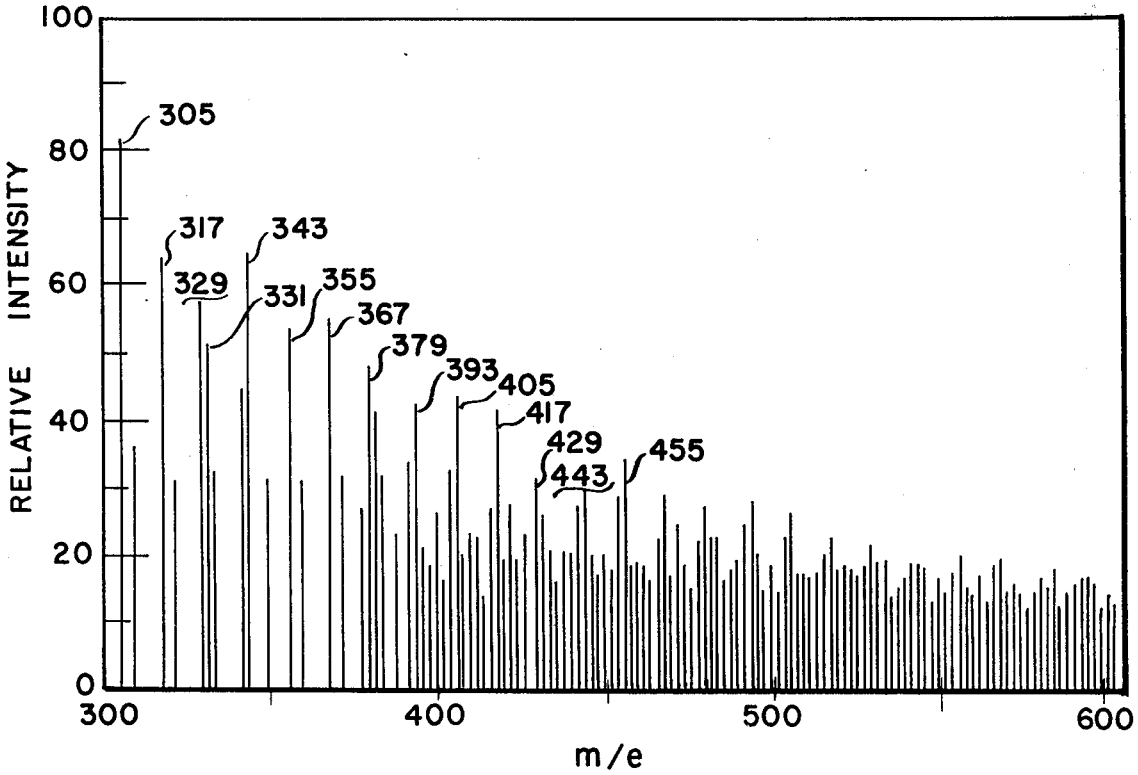
FIG. 2 depicts the mass spectrum of either the fluorinated coal or the distillation product of the present invention from $m/e$ 300 to 600, showing only the odd $m/e$ peaks.

FIGS. 1 and 2 compare the mass spectrums of perfluorokerosene and the fluorinated products of the present invention from about *m/e* 300 to 600. It can be seen that the conspicuous fluorocarbon fragments of perfluorokerosene are also conspicuous in the spectrum of the distillate. The spectrum of the distillate displays a uniform character of gradually diminishing intensity persisting to at least *m/e* of 1500. There is an even-odd pattern of alternating intensities with peaks of odd *m/e* more intense than adjacent peaks of even *m/e*. For clarity, only peaks of odd *m/e* are shown in FIG. 2. While the peaks shown in FIG. 2 are for the distillate, it should be noted that the fluorinated coat will present the same peaks and is equally useful as a mass spectrometric standard.

The following examples are given for illustrating the method of the invention for fluorinating coal, but are not to be taken as limiting the scope of the invention which is defined by the appended claims.

EXAMPLE I 54.4 mg of bituminous coal (77.9% C, 5.30% H) was fluorinated at 24° C during a one-day time interval by adding small amounts of fluorine gas in 21 increments. The fluorine pressure of the first increment was 70 mm Hg, while the pressure of the final increment was 889 mm Hg. The total fluorine added would have produced a pressure of 4.30 atmospheres if it had not been reacted. The HF liberated from the coal during fluorination and absorbed in HF was 54.5 mg, which corresponds to a recovery of 94% of the hydrogen in the coal in the form of HF. The initial 54.4 mg of bituminous coal fluorinated to give 131.3 mg fluorinated coal for a weight ratio of 2.41.

EXAMPLE II 56.5 mg of anthracite coal (87.6% C, 3.31% $H_2$) was fluorinated at 25° C during a 3-day time interval by adding fluorine gas in 20 increments. The initial fluorine gas pressure over the coal was 178 mm Hg, while fluorine pressure of the final increment was 1600 mm Hg. (The total fluorine added would have produced a pressure of 6.14 atmospheres if it had not reacted with the coal.)

The HF liberated from the coal and absorbed in NaF was 36.8 mg which corresponds to a recovery of 98% of the hydrogen in the coal in the form of HF. The initial 56.5 mg of anthracite coal fluorinated to give 154.8 mg fluorinated coal for a weight ratio of 2.74.

It might be noted that anthracite coal reacts more slowly than bituminous coal and it is easier to build the pressure up to over 300 mm Hg which may result in the coal igniting. It is for that reason that the anthracite coal was fluorinated over a longer period of time.

As can be seen from the examples and discussion, the method of the invention results in a safe and effective method for fluorinating coal, and the product of the method, either as the solid fluorinated coal or the solid distillate of the fluorinated coal, results in an effective and accurate internal standard for unit mass assignment in a mass spectrometer.

The embodiments of the invention in which an exclusive property or privilege is claimed are defined as follows:

1. A method for fluorinating coal comprising:
- contacting the coal with elemental fluorine at a temperature between 0° and 80° C and at an initial pressure of from 50 to 300 mm Hg;
- maintaining the initial pressure of the fluorine until the coal is partially fluorinated;
- increasing the pressure of the fluorine over the partially fluorinated coal slowly to from 1100 to 1600 mm Hg; and
- maintaining the pressure of the fluorine for a period of time sufficient to completely fluorinate the coal, thereby forming fluorinated coal.

2. The method of claim 1 wherein the pressure is increased slowly over a period of about 1 to 4 days.

3. The method of claim 2 wherein the coal is selected from the group consisting of anthracite and bituminous.

4. The fluorinated coal product produced by the method of claim 1.

5. The method of claim 3 including the additional steps of heating the fluorinated coal under a vacuum to pyrolytic temperature and collecting the fluorinated coal decomposition product.

6. The fluorinated distillate produced by the method of claim 5.

* * * * *